US006705035B2

(12) United States Patent
Gussalli Beretta

(10) Patent No.: US 6,705,035 B2
(45) Date of Patent: Mar. 16, 2004

(54) BARREL BALANCING DEVICE FOR COLLAPSIBLE FIREARMS

(75) Inventor: Ugo Gussalli Beretta, Gardone Val Trompia (IT)

(73) Assignee: Fabbrica d'Armi Pietro Beretta S.p.A., Brescia (IT)

( * ) Notice: Subject to any disclaimer, the term of this patent is extended or adjusted under 35 U.S.C. 154(b) by 0 days.

(21) Appl. No.: 10/289,783

(22) Filed: Nov. 7, 2002

(65) Prior Publication Data

US 2003/0089015 A1 May 15, 2003

(30) Foreign Application Priority Data

Nov. 14, 2001 (IT) ..... MI2001A2400

(51) Int. Cl.[7] ..... F41C 3/00
(52) U.S. Cl. ..... 42/40
(58) Field of Search ..... 42/44, 75.04, 75.02, 42/40

(56) References Cited

U.S. PATENT DOCUMENTS 804,349 A * 11/1905 Flodman et al. ..... 42/40
1,924,656 A * 8/1933 Ribe ..... 42/40
4,156,980 A 6/1979 Aspenwall ..... 42/40
4,541,192 A * 9/1985 Flodman et al. ..... 42/40
5,469,649 A 11/1995 Rowlands et al. ..... 42/40

FOREIGN PATENT DOCUMENTS

EP 0 862 038 9/1998

* cited by examiner

*Primary Examiner*—Harold J. Tudor
*Assistant Examiner*—Denise J Buckley
(74) *Attorney, Agent, or Firm*—Hedman & Costigan, P.C.

(57) ABSTRACT

A barrel balancing device for collapsible firearms (20) wherein at least one barrel (9) which is rotatable about a fixed hinging point (7) arranged on a action body (6), wherein an open-close top lever (13) is provided between a closed aligned position of the at least one barrel (9) and the action body (6), and a position disengaged and rotated upon opening of said at least one barrel (9) with respect to said action body (6), the at least one barrel (9) being carried by an iron fore-end (8), wherein at least one elastic or viscoelastic group (21, 22, 23, 24, 25, 26) is foreseen which interacts between the iron fore-end and the action body to oppose the falling motion of the at least one barrel (9), once the open-close top lever (13) is unlocked, and to realize a balancing push with respect to the weight of the at least one barrel (9) when the collapsible firearm (20) is closed.

8 Claims, 3 Drawing Sheets

BARREL BALANCING DEVICE FOR COLLAPSIBLE FIREARMS

The present application claims priority to Italian Patent Application Serial No. MI 2001A 002400, filed Nov. 14, 2001.

BACKGROUND OF THE INVENTION

The present invention regards a barrel balancing device for break open firearms.

In general, in the field of hand-held firearms and in particular rifles in which the firearm is opened by rotation of the barrel (or barrels) with respect to the breech (or action body), different solutions have been proposed which in some way are intended to balance the barrel or barrels.

Hereafter specific reference shall be made to over-and-under rifles meant for hunting or shooting it being understood that such references can be applied to all collapsible firearms, including side-by-side, semi-automatic, rifled and military ones, etc.

Moreover, given that the invention is directed to experts in the field of firearms, the detailed description of the operation of a rifle has been omitted with regard to the over-and-under rifle which is described. Only the functions of the firearm parts which relate to the technical problem that forms the basis of the invention. Brief mention is made to a common rifle 20, shown in FIG. 1, where its central part is illustrated in the closed position.

In such a figure a barrel or a barrel group 9 is connected to an action body 6 through a hinge pin 7. Such a hinge pin, once the rifle is unlocked through an opening top lever 13, allows the rotation of the barrel group 9 with respect to the action body 6. It is clear that in open position there, the barrel group is in a position such as to allow the expulsion of the cartridge cases and the loading, by the shooter, of new cartridges for subsequent firing.

An iron fore-end 8, is inserted into a fore-end 12, having the function of a grip for the hand of the user, has the function of holding the barrel group 9 locked to the action body 6 and also of allowing dismantling the barrel, once a suitably foreseen fore-end iron catch 11 has been released. Indeed, in the operation of the rifle the iron fore-end acts as a countering rod between a tenon of the barrels 10 and the action body 6. The lock realised by the hinge pin 7 is thus ensured when the barrels are open, preventing the accidental dismantling of the barrels themselves.

Besides this main function, it is known to also provide the iron fore-end with the task of ensuring a sufficient "pull" between barrel group and action body, a characteristic realised by forcing the iron fore-end through suitable adjustment of the position of the aforementioned tenon.

This "pull" characteristic is desirable since, by realising a countering force in the iron fore-end/action body contact, friction is generated which is capable of creating a state of equilibrium between the open barrels and the action body 6, which would out of balance due to the weight of the barrels.

Thus, at the time of assembly, it is established practice to carry out a manual adjustment on the tenon of the barrels 10 so as to provide a frictional force of the] against the iron fore-end. Such a step which gives the rifle a characteristic "hard" rotation or a certain resistance of the barrels to movement relative to the action body, does however have drawbacks.

Indeed, by providing a frictional force against the iron fore-end, even when optimal to counter the weight of the barrels, [obliges] the user or shooter, in the barrel loading step, is obliged to apply a substantial additional force in order to overcome the frictional resistances.

Moreover, a small variation of the manual adjustment of the tenon position generates a large variation of the iron fore-end/action body contact force due to the high rigidity of the iron fore-end/action body. Such a variation, besides creating friction, and extremely variable operation from rifle to rifle, can be the cause, in the case of excessive pull of seizures of the iron fore-end/action body contact surfaces.

Finally, given the criticality of the forcing position, a small variation due to normal operating wear, can cause the ideal operating conditions to prematurely deteriorate. In practice, after a few hundred openings/closings, there is a loss of initial pull.

A solution to this technical problem, has been a self-compensating elastic element which is not sensitive to wear. The pull function, usually carried out by the iron fore-end (Franchi patent), is connected to this elastic element. Such an element, in the form of a very powerful spring that is integrated within the iron fore-end, does not, however, solve the problem generated by the friction. Indeed, since small contact forces in the order of between 200 and 300 kg have to be generated in order to realise an acceptable balance, substantial resistance to the iron fore-end/action body rotation is created. Therefore, an object of the present invention is to overcome the limitations of the prior art by attempting to achieve a balanced state which is long-lasting and constant, and which allows easy opening and closing of the firearm by the user.

Another object of the present invention is providing the least possible friction between the iron-fore end and the action body, with small differences between firearms such as rifles.

An object which is fundamental to the previous objects is that of providing low actuation forces and low wear in the moving parts.

Yet another object of the present invention is that of providing good cost-effectiveness in manufacturing and simplicity of assembly.

SUMMARY OF THE INVENTION

These and other objects according to the present invention are achieved by providing a barrel balancing device for collapsible firearms as follows:

The barrel balancing device for collapsible firearms (20) has at least one barrel (9) which is mobile for rotation about a fixed hinging point (7) arranged on an action body (6), wherein an open-close top lever (13) is provided between a closed aligned position of said at least one barrel (9) and the action body (6), and a position disengaged and rotated upon opening of said at least one barrel (9) with respect to the action body (6), the at least one barrel (9) is carried by an iron fore-end (8), having at least one elastic or viscoelastic group (21, 22, 23, 24, 25, 26) which interacts between said iron fore-end and said action body to oppose the falling motion of said at least one barrel (9), once said open-close top lever (13) is unlocked, and to realise a balancing push with respect to the weight of said at least one barrel (9) when said collapsible firearm (20) is closed.

The characteristics and advantages of a barrel balancing device for collapsible firearms according to the present invention shall become clearer from the following description, which is given as an example, and not for limiting purposes.

DETAILED DESCRIPTION OF THE INVENTION

Figure 2:
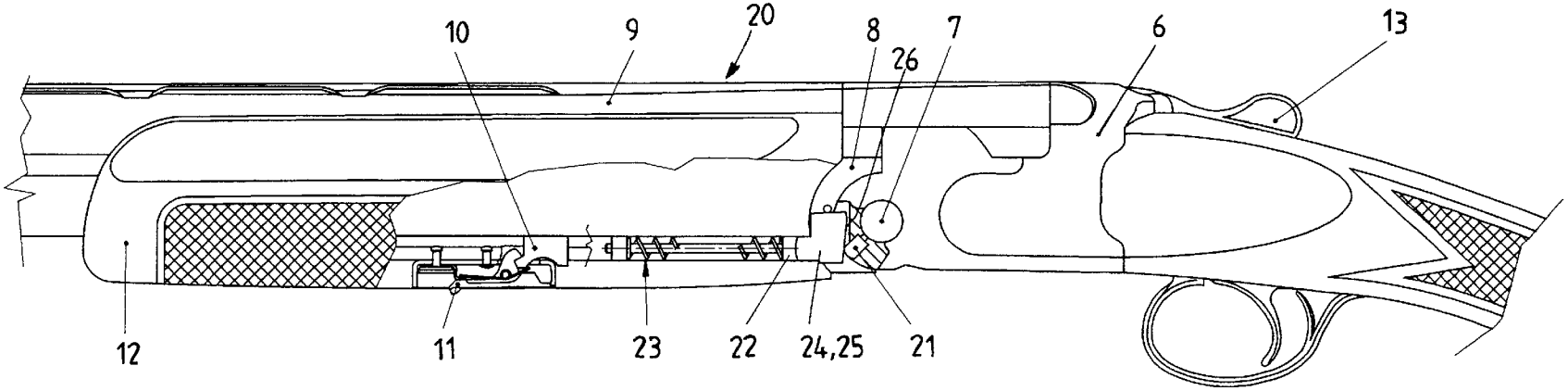
FIG. 2 is a side elevation view of a central part of a rifle according to the invention, in partial section and with the barrels closed.
Figure 4:
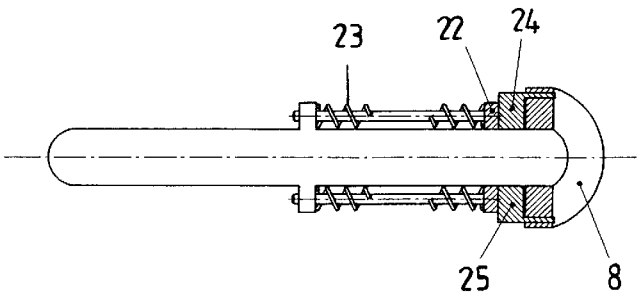
FIG. 4 is a plan view of the iron fore-end carrying the device.
Figure 3:
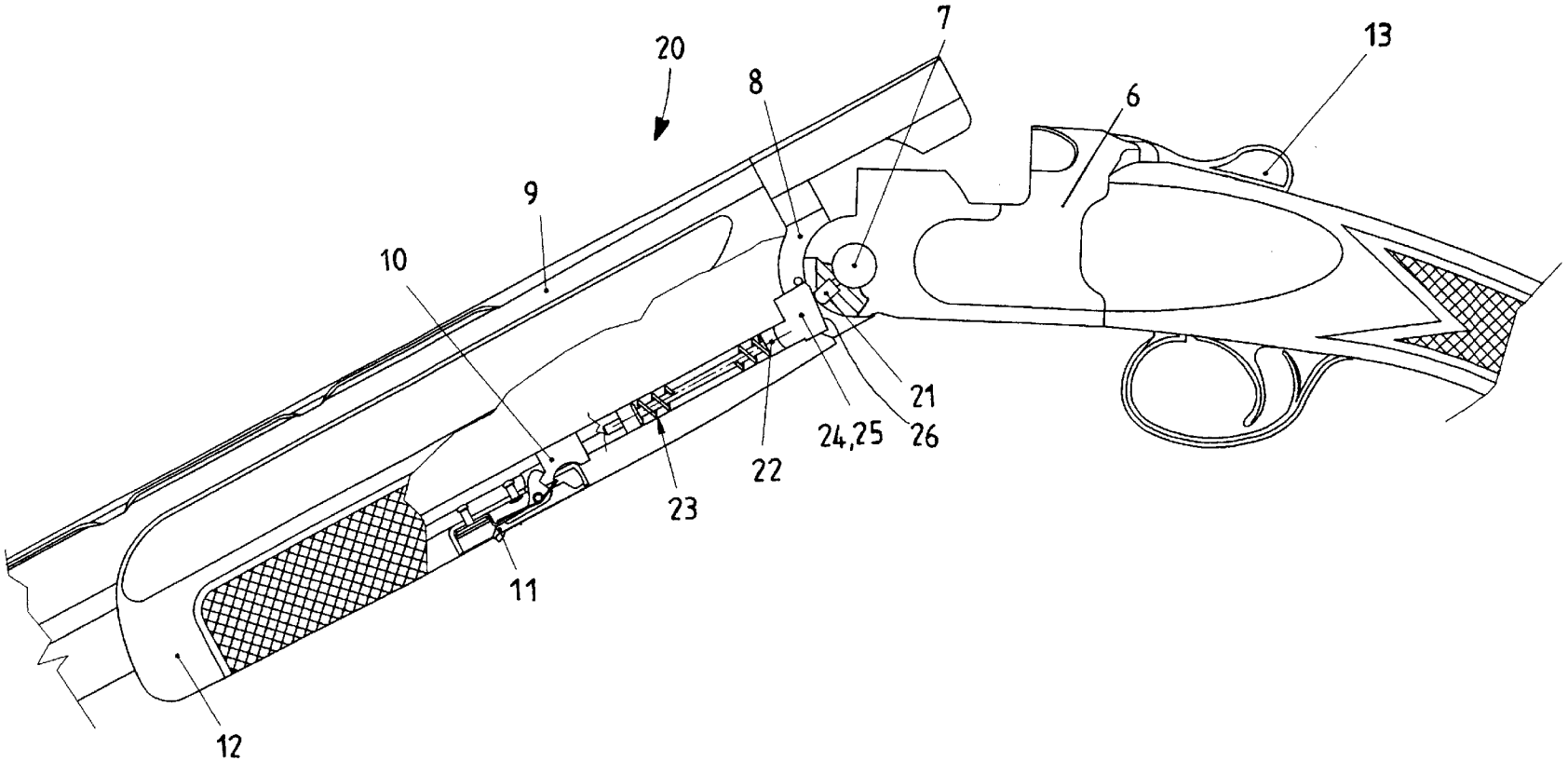
FIG. 3 is a side elevation view, similar to the one in FIG. 2, where the rifle according to the invention has the barrels open.

For a better understanding of the invention, reference is made to FIGS. 2, 3 and 4 in which a barrel balancing device for collapsible firearms is shown in a rifle with a single bore or with two over-and-under barrels.

The invention provides a technique whereby the balancing torque is achieved by means of the iron fore-end/action body forcing and the consequent contact friction, but rather by the action of an active balancing force which generates an equal and opposite action to that of the weight force.

Figure 1:
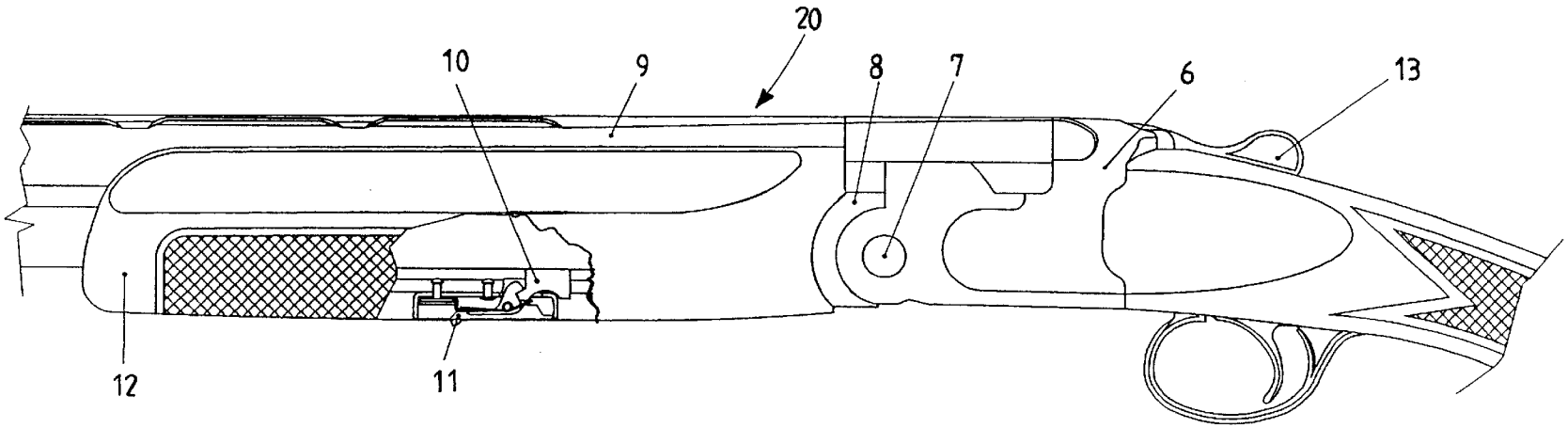
Fig.1 PRIOR ART
FIG. 1 is a partial section side elevation view of a piece of a central part of a closed rifle according to the prior art with the iron fore-end forced upon the action body.

In particular, the invention can be seen clearly from FIGS. 2–4, in which the elements similar or corresponding to those of the prior art are indicated with the same reference numerals as the previous FIG. 1.

It should therefore be noted in the example shown that in a collapsible rifle 20, balancing forces are provided which are capable of creating a counter torque to counteract the torque that is generated by the weight force. In particular this is achieved in the example by an elastic group which foresees two balancers, right balancer 24 and left balancer 25, relative spring guides 22 and springs 23. In the example the various elements are in pairs but a single arrangement of suitable force is also contemplated. As an alternative to the elastic group described above, it is conceivable to use any other elastic or viscoelastic system, i.e. a viscous characteristic which counteracts the falling motion of the barrel and a position-recovery elastic function.

Such forces, coming from the compression of the spring guides 22 by suitable push rods 21, mounted on the action body 6, act directly on the iron fore-end 8 and therefore, through the tenon 10, on the barrel group 9, according to a line of action which is suitably misaligned with respect to the axis of the hinge pin 7, and is in opposition to the weight force. More precisely, the push rods 21 act upon cam surfaces 26 which are formed at the rear of the right balancer 24 and/or left balancer 25. In particular, the right and left balancers 24 and 25 have an optimised profile so as to realise a perfect balancing according to the angle of opening and a stop function at the end of the opening stroke of the barrels 9.

It should also be noted that such balancers, relative springs and spring guides are integrated in the structure of the fore-end 12 (although this is not necessarily so since it is just as practicable to integrate them on the side of the action body), according to the diagram shown in FIGS. 2, 3 and 4 so as to be completely hidden from view with the rifle assembled.

The right balancer[s] 24 and the left balancer 25 extend out from the body of the iron fore-end 8 through suitable slits of a height proportional to the rotary stroke of the barrel 9, with the pushing surface 26 facing towards the counter push rods 21.

The different ways of operating with respect to the conventional system (active balancing force against passive friction force) reduces the iron fore-end/action body contact pressure to very low levels. For example, depending upon the lever arms and the mass of the barrel group, the force needed for each of the two springs can be set at about 20 kg.

Consequently, the device of the invention does not present any appreciably large passive resistance, i.e. friction, to the closing of the barrels. In fact, an at least partial self-closing effect can be realised. Moreover, the problem of possible seizures due to excessive contact forces is solved. The wear from contact between push rods 21 and balancers 24, 25, if present, has no influence upon the operating conditions which remain constant for the whole lifetime of the firearm. The balancing effect is influenced little by the loading of the firearm since the force of the springs 23 is substantially stronger with respect to that of the ejection hammer springs (not shown). The calibration of the device, relative to the balancing effect, is realised in the intermediate condition by a single unloaded ejection hammer.

A suitable sizing of the balancers, for example a special angulation of the contact surface with the push rods, so as to create suitable misalignments of the balancing force according to the opening angle of the barrel, allows the characteristic balancing curve to be optimised, as well as the use of special elastic elements such as variable pitch springs, progressive springs, etc. For example, a change in the inclination in the last degrees of the work stroke of the balancers allows a stop position at the end of the opening stroke of the barrels themselves to be provided by inverting the arm of the balancing force with respect to the center of rotation of the barrel.

Another, highly desirable advantage of the invention is that, once the fore-end iron catch 11 is freed, the fore-end may be easily dismantled which is an advantage that results from the extremely low forcing, limited to the force applied by the springs, of the iron fore-end between barrel tenon and action body.

Advantageously, by foreseeing a device according to the invention, it is possible to use alternative materials for the iron fore-end, such as light alloys, to gain a saving in terms of treatment costs and weights.

It is clear that a device according to the invention can be mounted on a firearm with collapsible barrel(s), i.e. wherein the opening of the firearm is achieved by rotation of the barrel (or barrels) with respect to the breech (or action body) plane, without any limitation as to the type of firearm which can be used for sport (for example an over-and-under, side-by-side or single-bore rifle, in this case even with semiautomatic operation), with a smooth or rifled bore.

It is equally clear that the barrel or the barrel group, possibly equipped with targeting sight members, may be moved by rotation with respect to a fixed hinging point arranged on a breech or action body.

The barrel or the barrel group according to the invention has its center of gravity in a misaligned position with respect to the hinging point so as to create an unbalancing torque tending to make it fall spontaneously once the closing device or top lever is unlocked.

A barrel balancing device for firearms of the present invention [thus conceived] is susceptible to numerous modifications and variants, all of which are within the scope of the invention.

Moreover, in practice the materials used, as well as their sizes and the components, can be varied according to the technical requirements.

What is claimed is:

1. A barrel balancing device for a break open firearm (20) wherein at least one barrel (9) which is rotatable about a fixed hinge pin (7) arranged on an action body (6), wherein an open-close top lever (13) is provided between a closed aligned position of said at least one barrel (9) and said action body (6), and a position disengaged and rotated upon opening of said at least one barrel (9) with respect to said action body (6), said at least one barrel (9) being carried by an iron fore-end (8), wherein said iron fore-end (8) is arranged on one side of said hinge pin (7) and said action body (6) is arranged on a side opposite said iron fore-end (8) which has attached thereto at least one elastic or viscoelastic group comprising at least one balancer (24, 25), at least one spring guide (22) and at least one spring (23) arranged on said spring guide (22), said at least one spring guide (22) being engaged on a side opposite said spring (23) with at least one balancer (24, 25), and at least one push rod, wherein said at least one push rod (21) acts according to a line of action which is misaligned with respect to said hinge pin (7), wherein said elastic or viscoelastic group interacts between said iron fore-end (8) and said action body (6) to oppose a force that is created when said at least one barrel (9) drops into an open position when said open-close top lever (13) is unlocked, and achieves an opposing force with respect to the weight of said at least one barrel (9) when said break open firearm (20) is in a closed position.

2. Device according to claim 1, wherein said at least one push rod (21) acts upon a cam surface (26) formed on the rear of said at least one balancer (24, 25).

3. Device according to claim 1, wherein said at least one balancer (24, 25), at least one spring guide (22) and at least one spring (23) are integrated in the structure of a fore-end (12) of said break open firearm.

4. Device according to claim 1, wherein said at least one balancer (24, 25) comes out from said iron fore-end (8) through slits of a, length proportional to a degree of rotation of said iron fore-end (8) in relation to said action body (6).

5. Device according to claim 1, wherein said at least one balancer (24, 25) has an optimized profile so as to achieve a perfect balancing or a partial self-closing effect according to an opening angle and a stop function at an end of an opening stroke of said barrel (9).

6. Device according to claim 1, wherein said at least one barrel (9) is equipped with a targeting system.

7. Device according to claim 1, wherein said at least one barrel (9) has a center of gravity in a misaligned position with respect to said hinge pin (7) in order to create an unbalancing torque to cause said least one barrel to fall spontaneously once said open-close top lever (13) is unlocked.

8. Device according to claim 1, wherein said iron fore-end (8) has a shaped end surface placed in rotary engagement with a matching end surface facing said action body (6).

* * * * *